US006082580A

United States Patent [19]

Mueller et al.

[11] Patent Number: 6,082,580

[45] Date of Patent: Jul. 4, 2000

[54] ARTICLE DISPENSING APPARATUS

[75] Inventors: Michael A. Mueller, Phoenix; Warren W. Stansberry, Peoria, both of Ariz.

[73] Assignee: Axxess Technologies, Inc., Tempe, Ariz.

[21] Appl. No.: 09/013,648

[22] Filed: Jan. 26, 1998

[51] Int. Cl.[7] ..... B65H 1/08

[52] U.S. Cl. ..... 221/226; 221/279; 414/750

[58] Field of Search ..... 221/123, 124, 221/226, 258, 279, 195, 310, 307; 414/750; 74/89.15, 424.8 R; 318/3, 4, 9; 187/267, 268

[56] References Cited

U.S. PATENT DOCUMENTS

| | | | |
|---|---|---|---|
| 3,908,859 | 9/1975 | Hohsmann | 221/279 |
| 4,638,677 | 1/1987 | Fuke | 74/84 R |
| 5,553,738 | 9/1996 | Roselli | 221/195 |
| 5,569,003 | 10/1996 | Goldman et al. | 409/132 |
| 5,813,568 | 9/1998 | Lowing | 221/279 |

*Primary Examiner*—Kenneth W. Noland
*Attorney, Agent, or Firm*—Finnegan, Henderson, Farabow, Garrett & Dunner, L.L.P.

[57] ABSTRACT

An apparatus for dispensing unpackaged articles includes a guide shaft to carry the articles, a pushing element that advances the plurality of articles along the guide shaft, and a feed screw engagable with the pushing element and driven by a motor. While the articles to be dispensed are moved collectively as a group, the apparatus provides for the controlled dispensing of individual articles. A sensor is provided to identify when an article has been dispensed and to subsequently stop movement of the plurality of articles. Also, an iris including a yieldable opening sized to allow passage therethrough of an article in a staggered manner is provided to facilitate the individual dispensing of articles and to prevent the inadvertent dispensing of articles.

24 Claims, 8 Drawing Sheets

ARTICLE DISPENSING APPARATUS

BACKGROUND OF THE INVENTION

The present invention relates to an automated article dispenser. While the present invention may be subject to a wide range of applications, it is especially suited for use in an automated vending machine.

Articles, such as for example, key rings, washers, screw nuts and variations of such articles, present difficulties to automated dispensing in a controlled manner. The difficulties involve the non-uniform nature of such articles, which are manufactured and purchased in bulk and are typically dispensed in unpackaged form. While substantially similar in overall size, shape, and appearance, the bulk nature of such items results in minor differences between individual items that, while not affecting the overall function of the item, can impede a controlled dispensing of such items.

Small ring-type accessory pieces that are used to attach a pet identification tag to a pet collar illustrate the nature of these problems. These rings come in an unpackaged form and tend to have irregularities when purchased in volume from vendors. The irregularities include being out-of-round, inconsistent outer and inner diameters, and varying thickness. Although these irregular rings can still function properly, the irregularities increase the difficulties associated with accurately dispensing the unpackaged accessory in an automated fashion through a vending machine.

In the case of an automated machine for engraving and dispensing pet identification tags, while a customer should receive one ring per pet tag for attaching the tag to the pet's collar, article dispensers in the past oftentimes will not dispense any ring. This upsets the customers and makes it impossible to use the pet tag. A more desirable article dispenser is one that is designed to reliably and consistently dispense at least one ring upon activation. Since these rings have essentially a de minimis value, the dispenser should be designed to err on the side of possibly dispensing more than one ring, rather than none at all.

In light of the foregoing, there is a need for a dispenser that is capable of dispensing unpackaged articles having certain irregularities and that is designed to ensure the dispensing of at least one article anytime it is activated.

SUMMARY OF THE INVENTION

Accordingly, the present invention is directed to an article dispensing apparatus that substantially obviates one or more of the limitations and disadvantages of prior art dispensing apparatus. The advantages and purposes of the invention will be set forth in part in the description which follows, and in part will be obvious from the description, or may be learned by practice of the invention. The advantages and purposes of the invention will be realized and attained by means of the elements and combinations particularly pointed out in the appended claims.

To attain the advantages and in accordance with the purposes of the invention, as embodied and broadly described herein, the invention is directed to an article dispensing apparatus comprising a guide shaft for supporting a plurality of articles, a pushing element moveable along the guide shaft between a first and second end thereof, a feed screw engagable with the pushing element, and a motor to drive the feed screw and advance the pushing element along the guide shaft toward the second end and thereby advance the plurality of articles toward the second end. A sensor system is positioned to sense an article being dispensed from the second end of the guide shaft. The sensor system deactivates the motor driving the feed screw upon sensing the dispensing of an article.

In another aspect, the present invention is directed to an article dispensing apparatus including a guide shaft having a first and second end for supporting a plurality of articles and a pushing element movable along the guide shaft. A means is provided for incrementally advancing the pushing element along the guide shaft to advance the plurality of articles toward the second end thereof. An iris, aligned with the second end of the guide shaft, staggers the movement of the articles passing therethrough and acts to prevent inadvertent dispensing of articles when the machine is moved. The iris comprises an opening surrounded by a plurality of fingers that are yieldable as the article passes through the opening.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of the specification, illustrate one embodiment of the invention and together with the description serve to explain the principles of the invention. In the drawings.

DESCRIPTION OF THE PREFERRED EMBODIMENTS

Reference will now be made in detail to the present preferred embodiment of the invention, an example of which is illustrated in the accompanying drawings. Wherever possible the same reference numbers will be used throughout the drawings to refer to the same or like parts.

Figure 1:
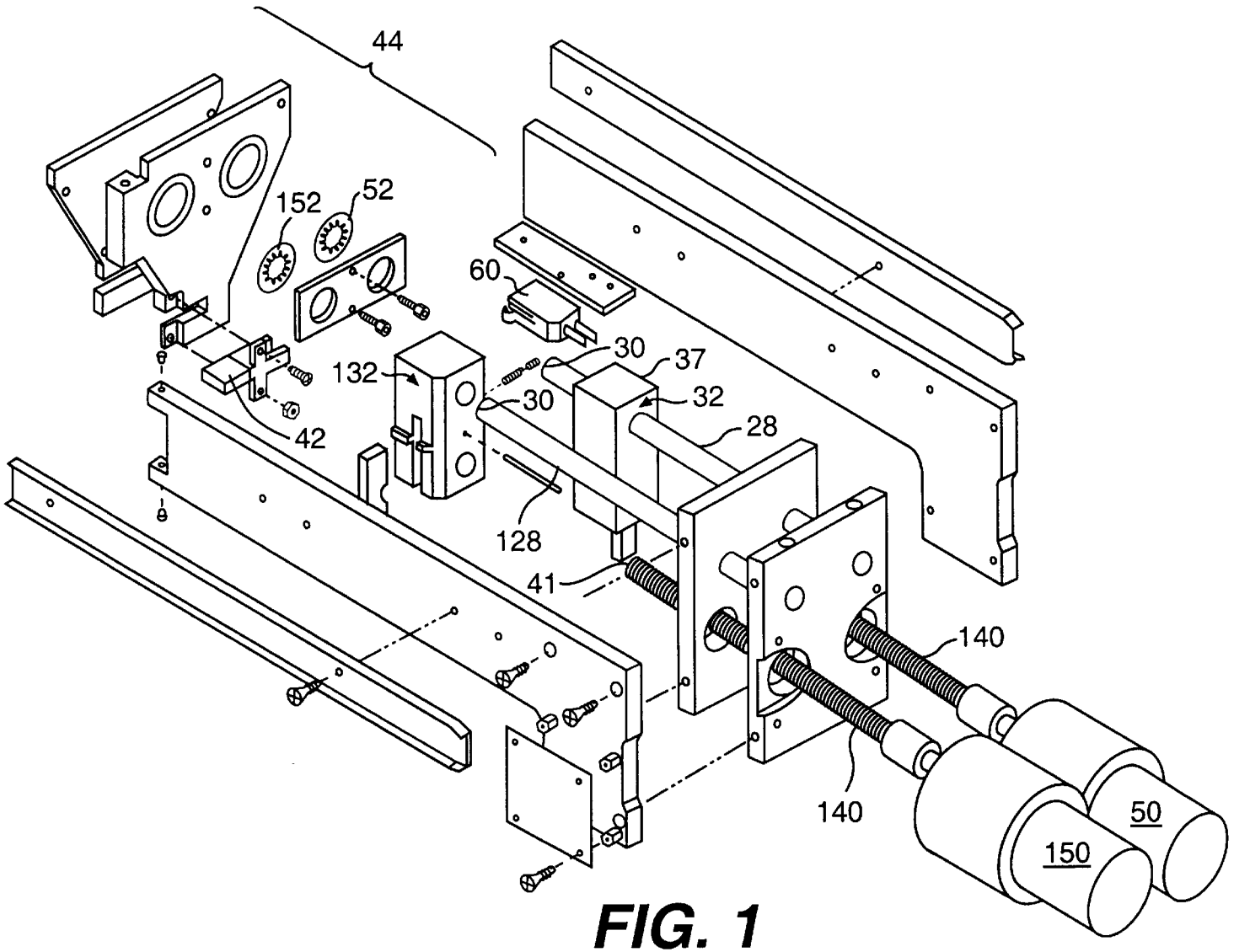
FIG. 1 is an exploded perspective view of an article dispenser in accordance with this invention.

In accordance with the present invention, an article dispensing apparatus is provided with at least one guide shaft for supporting a plurality of articles to be dispensed. The guide shaft includes first and second ends. The presently preferred embodiment of the present invention is generally shown in FIG. 1 having a pair of guide shafts 28 and 128, which are intended to hold ring-shaped articles (not shown). In this preferred embodiment, the guide shaft is circular in cross section in order to store ring-shaped articles. The quantity and shape of the guide shafts of the apparatus can vary depending upon the shape of the article to be dispensed and the desired inventory of articles to be maintained in the apparatus.

Figure 2:
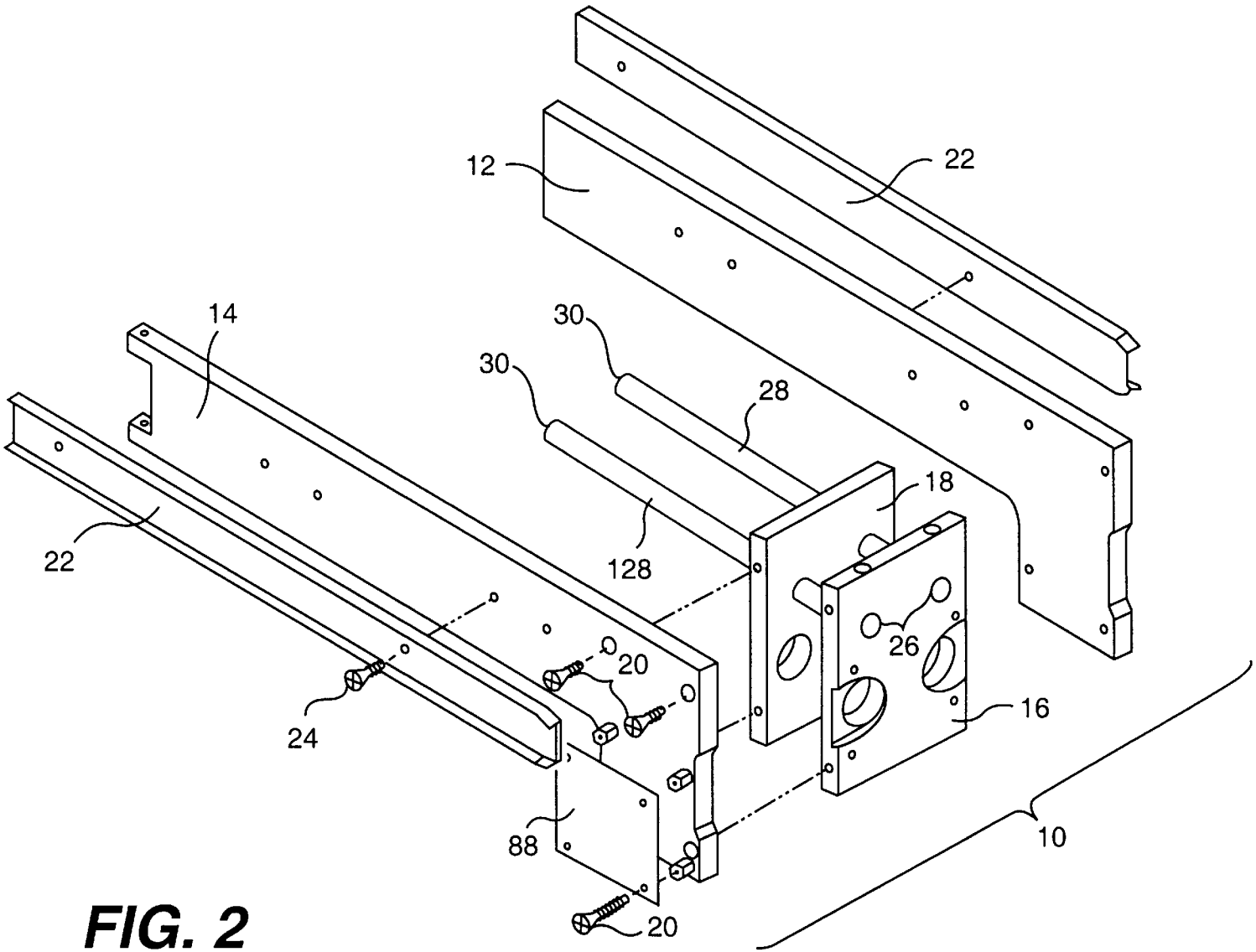
FIG. 2 is an exploded perspective view of a frame assembly of the article dispenser shown with a pair of guide shafts.

As embodied herein and as best shown in FIG. 2, the article dispenser includes a frame assembly 10 which includes left and right side plates 12 and 14, respectively, along with rear and front bearing plates 16 and 18, respectively. The side plates 12 and 14, and bearing plates 16 and 18, are secured by screws 20, for example, but other suitable fastening devices may be used. Side plates 12 and 14 are preferably attached to a set of slide rails 22 to facilitate removable support of the dispensing apparatus in another apparatus, such as an automated vending machine. Screws 24 may be used to attach the side plates 12 and 14 to the slide rails 22.

As embodied herein and as shown in FIG. 2, rear bearing plate 16 supports the rear ends 26 of guide shafts 28 and 128, while the front bearing plate 18 supports the guide shafts 28 and 128 forwardly to cantilever the free ends 30 of the guide shafts 28 and 128. The rear ends 26 of the guide shafts may be attached to rear bearing plate 16 by any known means, such as press fitting, bonding, or set screws.

In accordance with the present invention, the article dispensing apparatus includes a pushing element moveable along a corresponding guide shaft. A means is provided to incrementally advance the pushing element to thereby incrementally advance the plurality of articles along the guide member. In the presently preferred and disclosed embodiment, the incremental advancing means includes a feed screw and a motor for driving the feed screw. It is contemplated that other methods for moving an element in a controlled manner can be utilized in lieu of the feed screw and motor combination. By means of example only, such mechanisms may include a belt and pulley, a cog belt drive with a gear head and slip clutch, or a chain drive with a gear head and slip clutch.

As embodied herein and as shown in FIG. 1, the article dispensing apparatus has two pushing elements 32 and 132. Two feed screws 40 and 140 are engagable with pushing elements 32 and 132, respectively. Motors 50 and 150 drive feed screws 40 and 140, respectively, to advance the pushing elements 32 and 132, respectively, along guide shafts 28 and 128, respectively, to thereby advance the plurality of articles stored on the guide shaft toward the second end thereof.

Figure 3:
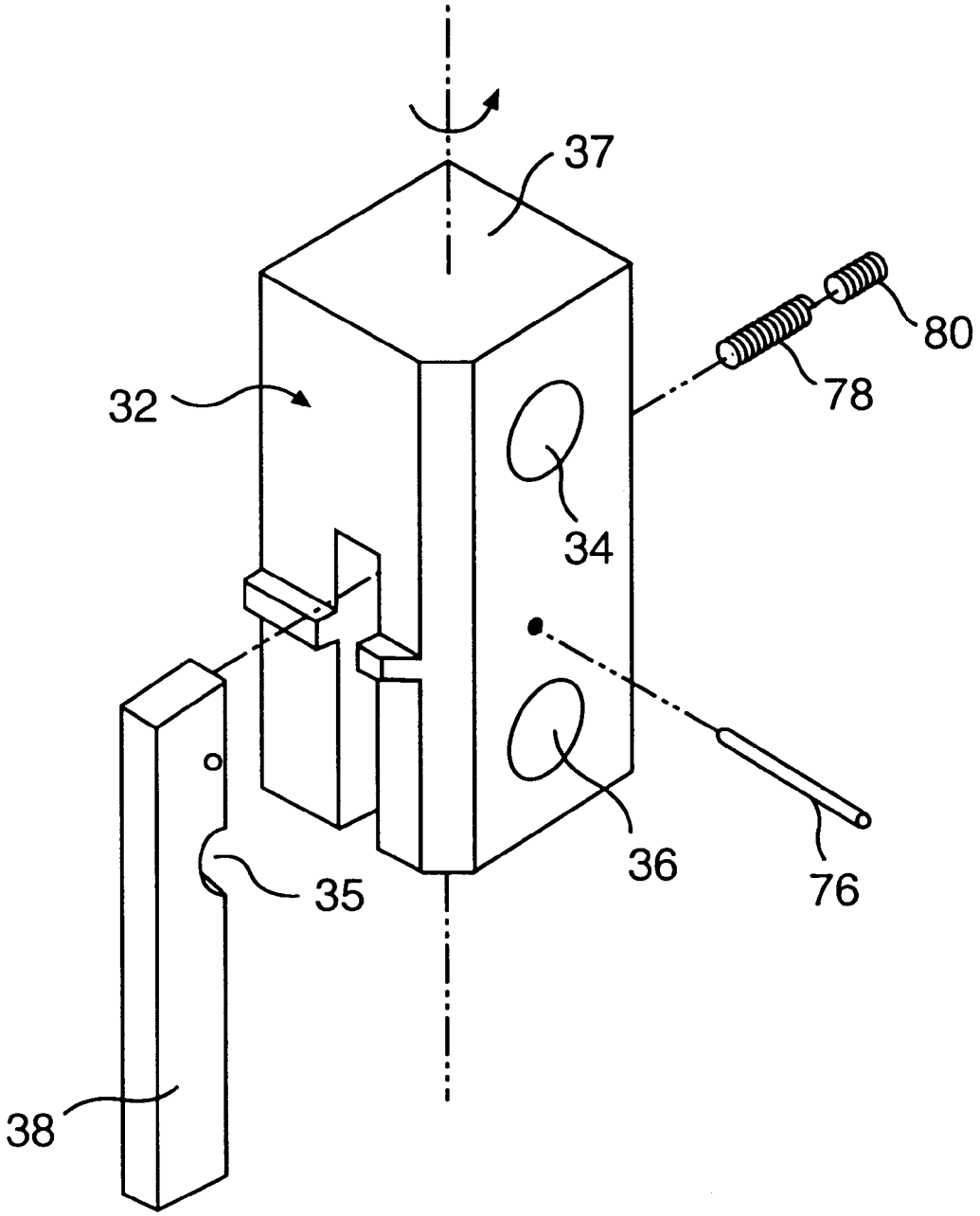
FIG. 3 is an exploded perspective view of a pushing element.

As best shown in FIG. 3, each pushing element 32 includes an upper circular opening 34, a lower circular opening 36, and a release lever 38 having a semi-circular threaded cut-out 35 concentric with the lower circular opening 36. The upper opening 34 is of a diameter to receive the guide shaft 28 with a slight tolerance to slidably support the pushing element 32 for movement of the articles without a change in fore and aft inclination and thus assure that the end surfaces of the rings are lined up perpendicularly to the axis of the guide shaft 28. The lower opening 36 is of a diameter to freely receive a feed screw 40. The feed screw 40 is firmly engagable with the release lever 38 carried in the pushing element 32. The release lever 38 is housed vertically midway on one side of the pushing element 32 adjacent to the nearest side plate, which is a left side plate 12 in this case, to be engagable with the feed screw 40.

An article dispenser of the present invention preferably includes a reloading mechanism comprising the release lever housed inside the pushing element, a pivot pin attaching the release lever to the pushing element while allowing the release lever to swing, and a spring positioned so as to create a moment around the pivot pin urging the release lever against the feed screw. FIG. 3 shows how the release lever 38 housed in the pushing element 32 provides a simple reloading mechanism for the preferred embodiment of the present invention. A pivot pin 76 attaches the release lever 38 to the pushing element 32, while allowing the release lever 38 to swing around the pivot pin 76. A screw 80 sets a spring 78 in place inside the pushing element 32 and is easily removable when replacement of a new spring is necessary. Spring 78 inside the pushing element 32, as schematically shown in FIG. 8A, is located so as to create a moment arm pressing the release lever 38 against the feed screw 40, thereby engaging the pushing element 32 to the feed screw 40. When the article dispenser is in an operation mode, the screw 80 holds the spring 78 in place as the spring 78 compresses causing the release lever 38 to pivot around the pivot pin 76 to engage with the feed screw 40.

Figure 8B:
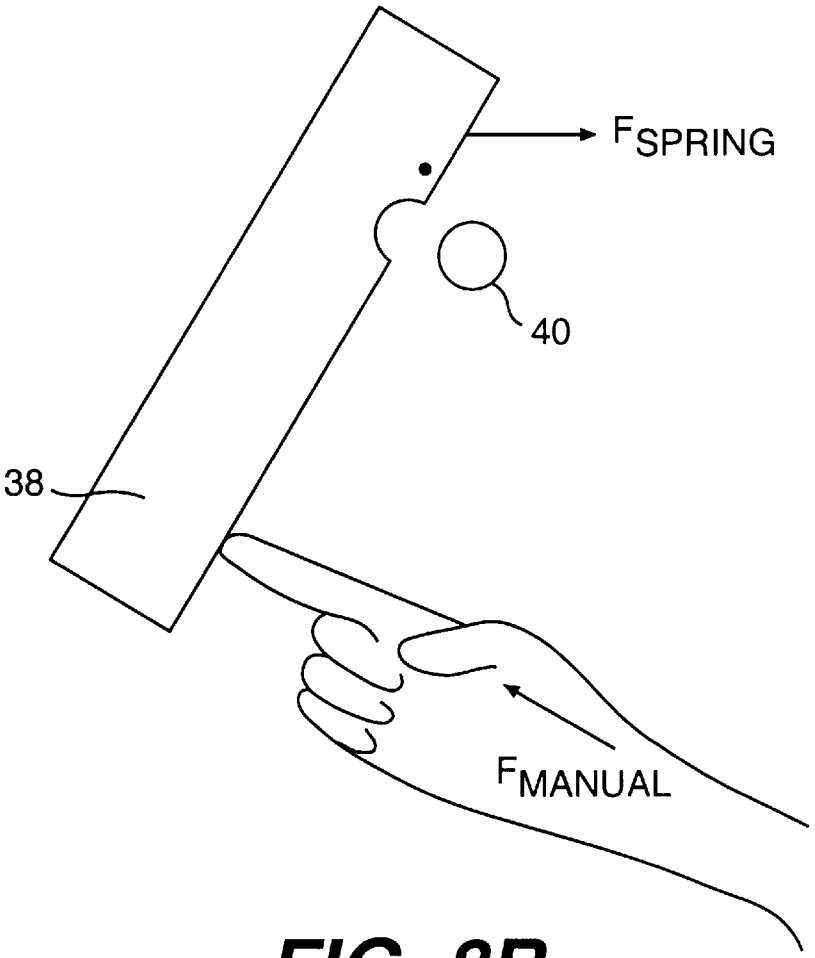
FIG. 8B is a schematic front view of a release lever in a reloading mode being disengaged from the feed screw.
Figure 8A:
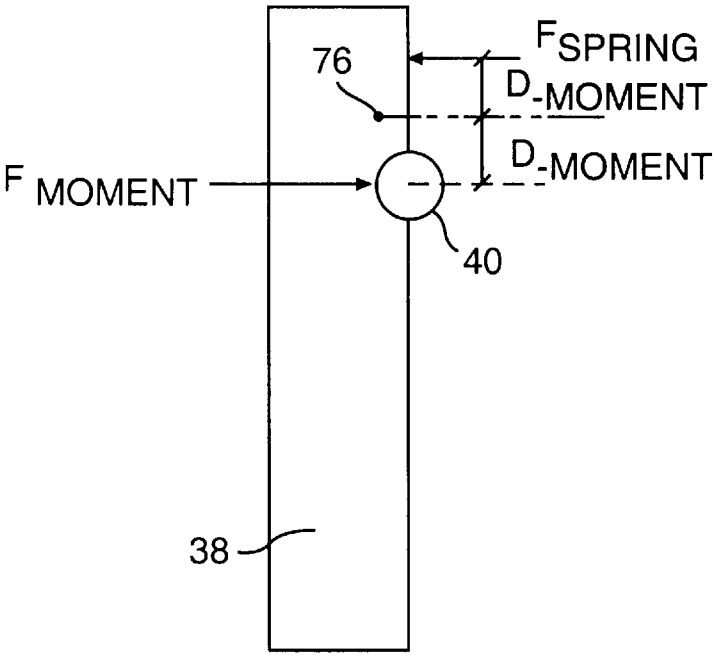
FIG. 8A is a schematic front view of a release lever in an operation mode being engaged with a feed screw.

FIG. 8B illustrates when the article dispenser is in a service or reloading mode. In this arrangement, the release lever 38 is disengagable by manually pivoting the release lever 38 around the pivot pin 76 away from the feed screw 40. While disengaged, the pushing element 32 is freely slidable along both the guide shaft 28 and the feed screw 40 toward the rear end 26 of the guide shaft 28 to allow for the dispenser to be refilled with new articles.

The spring loaded release lever 38 provides the additional benefit of avoiding damage to the machine in the event of a jam. Should a jam occur, the release lever is configured to trip open and become disengaged from the feed screw. The shape of the threads is designed to overcome the biasing force of spring 78. Accordingly, there is no need to utilize a separate slip clutch to avoid damage in the event of a jam.

Both of the pushing elements 32 and 132 are identical in shape. For ease of disengagement, one is preferably rotated 180 degrees from the other about a vertical axis passing through the top surface 37 of the pushing element 32. Accordingly, the upper opening 34 and the lower opening 36 of the second pushing element 132 are to receive the second guide shaft 128 and the second feed screw 140, respectively.

Figure 4:
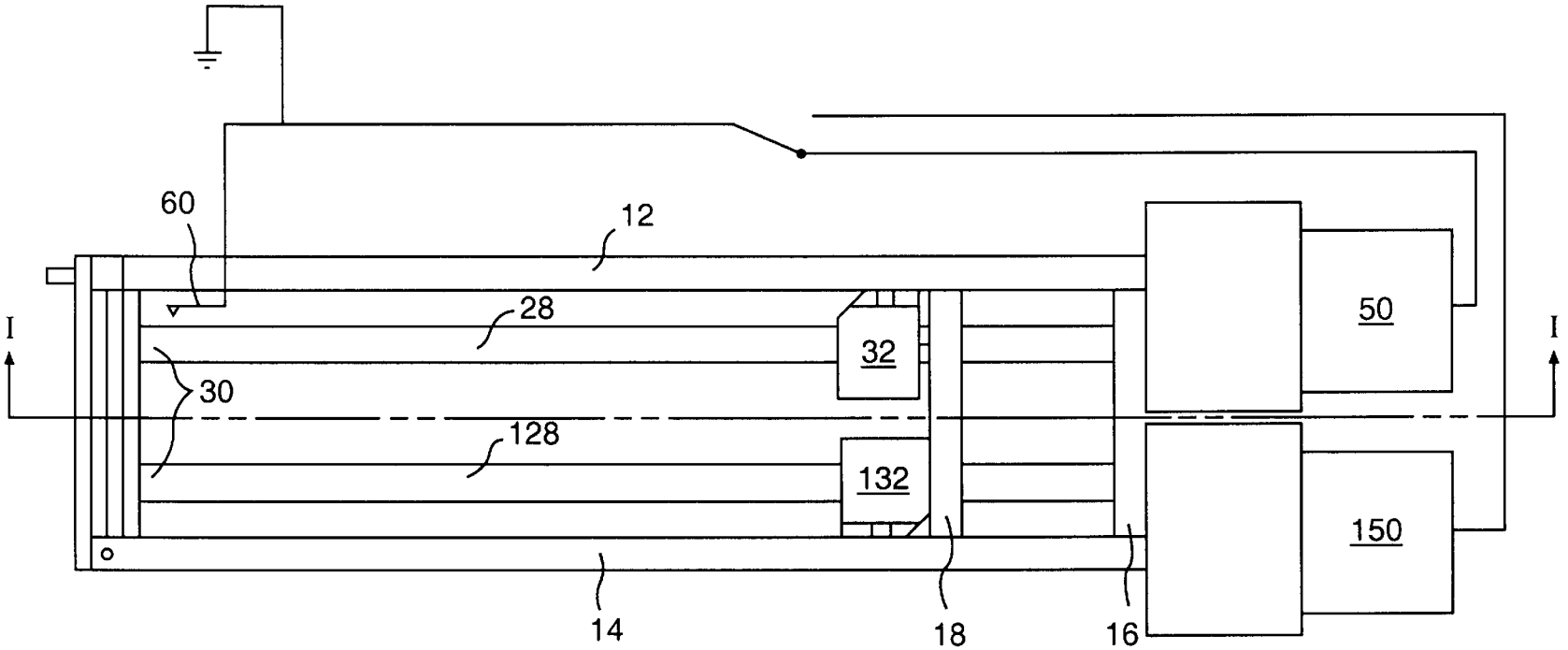
FIG. 4 is a top pictorial view of the article dispenser.
Figure 5:
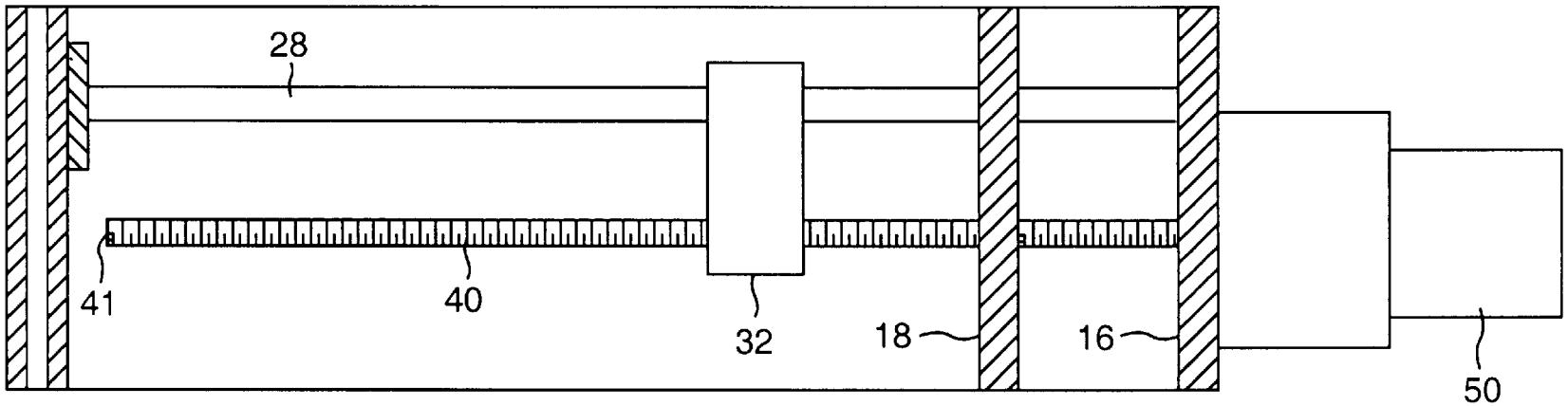
FIG. 5 is a partial cross-sectional view of an article dispenser of the present invention taken along line l—l of FIG. 4.

As shown in FIGS. 4 and 5, the feed screws 40 and 140, located directly beneath the guide shafts 28 and 128, are supported by the rear bearing plate 16 on one end, pass through openings in the front bearing plate 18, and are supported by the lower circular openings 36 of the pushing elements 32 and 132, as the pushing elements 32 and 132, travel along the guide shafts 28 and 128.

In accordance with the present invention, the article dispensing apparatus includes a sensor system positioned to sense an article dispensed from the second end of the guide shaft(s). The sensor system may deactivate the motor driving the feed screw upon sensing the dispensing of an article. The sensor system should be located in a position where it will be able to consistently and accurately detect the movement of an article as it is dispensed.

Further in accordance with the invention, the article dispensing apparatus includes a detachable chute unit comprising parallel chute plates, a pivot point connecting the chute unit to the frame assembly while allowing the chute unit to be moved, and a latching mechanism to fasten and release the chute unit to the frame assembly. The parallel front and back chute plates taper on the bottom portion to narrow the chute channel where the articles are designed to drop so that ultimately all articles passing through the chute unit may be readily detected by a sensor located on the bottom portion of the chute unit.

Figure 6:
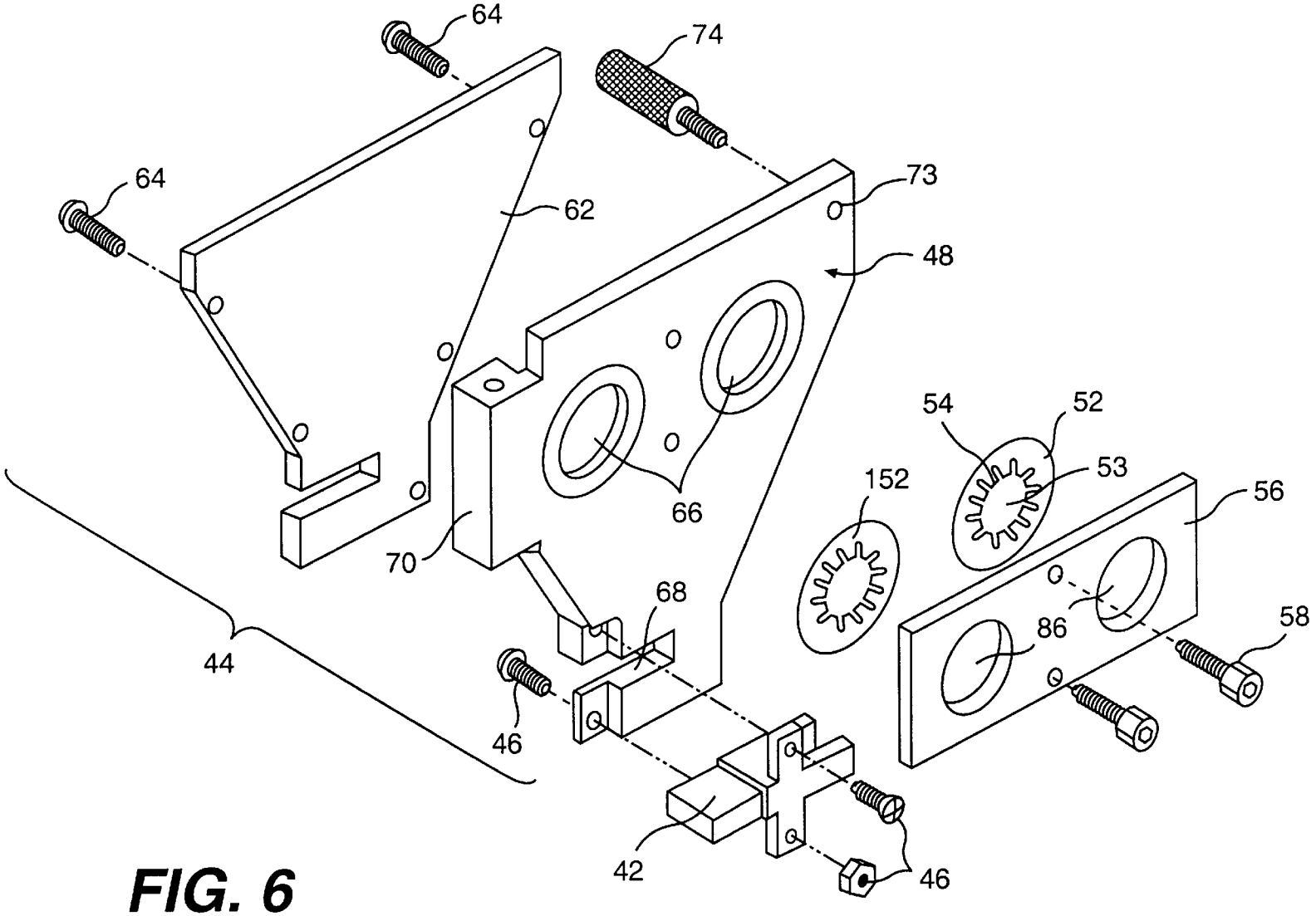
FIG. 6 is an exploded perspective view of irises attaching to a chute unit.

In the illustrated embodiment and as best shown in FIG. 6, the chute unit 44 comprises rear and front chute plates 48 and 62, respectively, which are spaced in parallel and attached by screws 64, for example, but other fastening devices may be used. The rear chute plate 48 comprises two circular openings 66 to house the irises 52 and 152, a cut-out 68 to receive a sensor, a vertical hinge strip 70 on the side of the rear chute plate 48 that is thicker than the rest of the rear chute plate 48 to provide spacing in the chute unit 44, and a threaded circular opening 73 on the side of the rear chute plate 48 to receive a thumbscrew 74 securing the chute unit 44 to the side plate 12 of the frame assembly 10.

Figure 7:
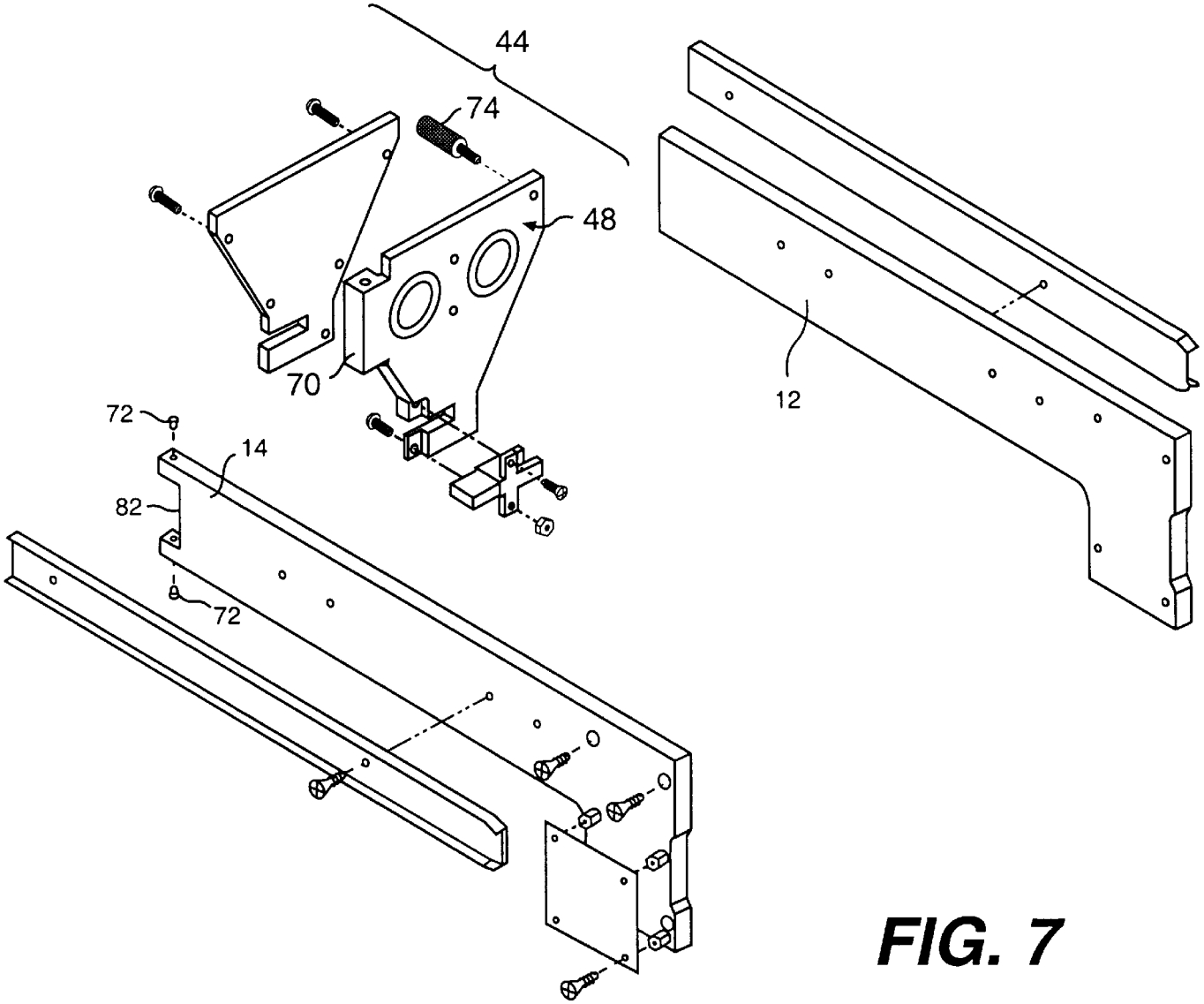
FIG. 7 is an exploded perspective view of a chute unit attaching to the frame assembly.

To provide easy access during reloading or servicing the dispenser, as best shown in FIG. 7, the chute unit 44 is movable between different positions. A set of pivot screws 72 attach the chute unit 44 to the side plate 14 and allow a rotational movement of the chute unit. A recess 82, in the front edge of the side plate 14 between pivot screws 72, receives the vertical hinge strip 70 of the rear chute plate 48. A latching mechanism, such as a thumbscrew 74, locks the chute unit 44 to the side plate 12 and easily unscrews to allow the chute unit 44 to be moved during servicing or reloading of the apparatus.

As embodied herein and as shown in FIG. 6, a sensor 42 is provided. Sensor 42 is located at the lower portion of a chute unit 44 where the articles are designed to drop by gravity upon release from the guide shafts 28 and 128. A pair of bolts and a nut, designated collectively as 46 in FIG. 6, fasten the sensor 42 to rear chute plate 48. The chute unit 44 tapers on the bottom portion to narrow the chute channel where the articles drop and to assure that all articles passing through the chute unit 44 will be exposed to the detection range of the sensor 42. In a presently preferred embodiment, sensor 42 is a photo micro sensor of the type manufactured by Omron as Model EES-X672. It is contemplated that other sensing systems can be used in the present invention and that the sensor can be placed at any position where it can reliably and consistently detect an article being dispensed.

In accordance with the present invention, the dispensing apparatus includes a means for preventing inadvertent dispensing of articles and staggering the movement of the plurality of articles along the guide member to facilitate the dispensing of individual articles. This means may include an iris positioned on or adjacent the second end of the guide shaft, the iris defining a yieldable opening to dispense the articles in a controlled manner. While the articles are advanced as a group, the iris facilitates individual dispensing by staggering movement of the articles as they pass therethrough. Thus, while the articles are advanced collectively to the iris, they emerge from the iris individually. Also, should the machine be tipped or moved, the iris acts to maintain the articles on the guide member, thereby preventing inadvertent dispensing of articles.

As embodied herein and as best shown in FIG. 6, iris 52 includes a yieldable circular opening 53 having a plurality of finger-like flaps 54 radially around the opening 53. The diameter of the circular opening 53 is sized to be smaller than the outside diameter of the articles. The flexibility or rigidity of the iris 52 determines the number of flaps 54 required; the more rigid the iris 52 is, the more flaps 54 are necessary. In the presently preferred embodiment, the iris 52 is shown to have twelve flaps 54. These yieldable flaps 54 extend toward the center of the opening far enough to allow one article on the free end 30 of the corresponding guide shaft 28 to pass and then delay or restrain the next articles from moving forward. In this respect, the iris acts as a mechanism to control the dispensing activity in a desired manner, including preventing the accidental dispensing of articles.

An alternative design of the present invention may utilize a single motor to drive two pushing element/feed screw combinations. To facilitate this arrangement, it is useful to utilize two staggered irises to provide for alternative dispensing from respective guide members. By utilizing the sensor of the present invention and staggering the irises along their respective guide members approximately ½ the width of the articles to be dispensed, the articles can be dispensed in alternative fashion from a pair of guide members.

Preferably, as shown in FIG. 6, the iris 52 is housed in a rear chute plate 48 and covered by an iris retainer 56. Both the rear chute plate 48 and the iris retainer 56 have the same number of circular openings 66 and 86, respectively, as the number of irises employed in the embodiment. The rear chute plate 48 and the iris retainer 56 securely hold the irises 52 and 152, to be axially aligned with the corresponding guide shafts 28 and 128. Screws 58 or other similar fastening devices can be used to attach the iris retainer 56 to the rear chute plate 48.

FIG. 1 illustrates the relationship of each aforementioned element and the mechanical function of the article dispenser. The motor 50 is activated by any number of known means, such as inserting a coin into a vending machine or by commands provided by a control system in a vending machine. The motor 50 rotates the feed screw 40 which then turns and engages with the release lever 38 inside the pushing element 32. As a result, the pushing element 32 advances and pushes a row of articles toward the free end 30 of the guide shaft 28. The iris 52 functions as a detent to discretely release each article on the free end 30 of guide shaft 28, and to restrain in a controlled manner the next article positioned at the free end 30 of the guide shaft 28 from immediately moving forward. Therefore, as the motor 50 turns the feed screw 40, the iris 52 delays the next article from moving forward. The article then passes through the iris 52 and falls into the chute unit 44.

The motor 50 keeps running and the pushing element 32 continues to move forward until the sensor 42 detects that one article has been dispensed. This reduces the risk that no article will be dispensed. When the sensor 42 distinctly detects the release of one article passing through the chute unit 44, it signals the motor 50 to shut off. The speed of motor 50 can be adjusted to minimize the chance that the dispenser will dispense two articles at a time.

A circuit card assembly 88 well known to those skilled in the art controls the logical sequence described above and, as shown in FIG. 2, is attached to the right side plate 14 by screws 20. As a safety feature, the circuit card assembly 88 may be equipped with a timer which overrides the sensor 42 and turns off the motor 50, after a set interval has lapsed from the time a coin is inserted into the vending machine or a control signal has been provided to initiate dispensing activity. This feature safeguards against occasions such as the malfunction of sensor 42 or when the article dispenser runs out of the articles.

The article dispenser according to a presently preferred embodiment of the invention presents two assemblies working in series. Each assembly preferably comprises a guide shaft, a feed screw, a pushing element, an iris, and a motor. The disclosed invention may contain any number of assemblies working in series depending on the inventory of rings needed in the dispenser.

As embodied herein and as shown in FIGS. 1 and 4, the article dispenser is provided with two assemblies working in series. Each assembly comprises a guide shaft 28 or 128, a feed screw 40 or 140, a pushing element 32 or 132, an iris 52 or 152, and a motor 50 or 150. Both assemblies are enclosed in one frame assembly, supported by a single rear bearing plate 16 and front bearing plate 18, and all articles are dispensed through one chute unit 44. Both pushing elements 32 and 132, are similar in shape, only one is rotated 180 degrees from the other for ease of release.

The apparatus of the present invention preferably includes a timer circuit as part of the sensor system to facilitate operation when more than one assembly is provided in the apparatus. If the sensor does not detect the dispensing of an article within a predetermined time period of, for instance, ten seconds, the sensor sends a signal that the dispensing apparatus should switch to the next assembly. Thus, in the event of a jam, electronic failure, or the first assembly running out of inventory, the system automatically provides for switching over to the next assembly in series.

Alternatively, the article dispenser of the present invention may be provided with a limit switch 60 connecting assemblies designed to work in series. FIG. 4 illustrates the limit switch 60 being connected to the first motor 50 when the first assembly of the article dispenser is in progress. But as the first pushing element 32 reaches the free end 30 of the first guide shaft 28, the limit switch 60 will open the connection to the first motor 50, make a connection with the second motor 150 and power the second motor 150 to initiate progress of the second pushing element 132 along the second guide shaft 128. When the second pushing element 132 has reached the free end 30 of the second guide shaft 128, all articles in inventory have been dispensed.

In the preferred embodiment, the second feed screw 140 may still turn after all articles have been dispensed without any damage being done to the dispenser. The reason is that, as shown in FIG. 5, the feed screw 40 is preferably shorter than the guide shaft 28, and the feed screw 40 is supported by the lower circular opening 36 of the pushing element 32. Similarly for the second assembly, shown generally in FIG. 1, the second feed screw 140 is preferably shorter than the second guide shaft 128 and the second feed screw 140 is supported by the lower circular opening 136 of the pushing element 132. Thus, when the second pushing element 132 reaches the free end 30 of the second guide shaft 128, the front end 41 of the second feed screw 140 is no longer engaged with the release lever 38 inside the second pushing element 132, but is nonetheless supported by the edge of the lower opening 36 rearward of the release lever 38 in the second pushing element 132. Therefore, when the dispenser has no more articles, the second motor 150 will run but the second feed screw 140 simply turns in idle. The second pushing element 132 will not press against the iris retainer 56 and no excessive stress is built up between the second pushing element 132 and the iris retainer 56.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An article dispensing apparatus, comprising:

a guide shaft for supporting a plurality of articles, the guide shaft having first and second ends;

a pushing element movable along the guide shaft;

a feed screw engagable with the pushing element;

a motor to drive the feed screw and thereby advance the pushing element along the guide shaft toward the second end and advance the plurality of articles toward said second end; and a sensor system positioned approximate the second end of the guide shaft to sense an article as the article is dispensed from the second end of the guide shaft, said sensor system deactivating said motor upon sensing the dispensing of an article.

2. The article dispensing apparatus of claim 1, wherein the sensor system includes a photo sensor.

3. The article dispensing apparatus of claim 1, wherein the apparatus comprises at least two guide shafts, at least two pushing elements movable along respective guide shafts, at least two feed screws, and at least two motors, said motors to drive respective feed screws successively in series.

4. The article dispensing apparatus of claim 3, wherein the sensor includes a timer circuit that deactivates a first motor and activates a successive one of the at least two motors upon sensing that no article has been dispensed after a predetermined time period has elapsed subsequent to activation of the first motor.

5. The article dispensing apparatus of claim 1, further comprising a frame assembly, including:

a first and second opposing side plate;

a rear bearing plate connected to said side plates and supporting the first end of the guide shaft; and a front bearing plate connected to said side plates, said front bearing plate being spaced from the rear bearing plate and supporting the guide shaft intermediate said first and second ends thereof, said rear and front bearing plates providing cantilevered support for the guide shaft.

6. The article dispensing apparatus of claim 5, wherein the feed screw extends substantially parallel to the guide shaft, said feed screw including a first and second end, with the first end thereof supported by the rear bearing plate, the feed screw being supported along its length by the pushing element as the pushing element moves along the guide shaft.

7. The article dispensing apparatus of claim 6, wherein the feed screw second end extends from the rear bearing plate a shorter distance than the guide shaft second end, such that the pushing element becomes disengaged from the feed screw as the pushing element advances to a point at or adjacent the second end of the guide shaft.

8. The article dispensing apparatus of claim 1, further comprising a chute element that receives an article being dispensed from the guide shaft and directs the article to a location such that the article will be sensed by the sensor system.

9. The article dispensing apparatus of claim 8, wherein the chute element comprises:

a first chute plate having at least one opening in axial alignment with the guide shaft, said opening being sized to allow an article dispensed from the guide shaft to pass therethrough; and a second chute plate spaced from the first chute plate to form a channel between said first and second chute plates, said channel guiding an article passing through said first chute plate opening to a dispensing location.

10. The article dispensing apparatus of claim 9, wherein the chute element is movably mounted between an engagement position in which the chute element is adjacent the second end of the guide shaft to receive articles dispensed therefrom and a restocking position in which the chute element is spaced from the guide shaft second end to allow for articles to be supplied to the guide shaft.

11. An article dispensing apparatus, comprising:

a guide shaft for supporting a plurality of articles, the guide shaft having first and second ends;

a pushing element movable along the guide shaft, the pushing element comprising a release lever with a threaded cut-out section, said release lever being movable between a first position in which said threaded cut-out section is engaged with the feed screw and a second position in which said threaded cut-out section is disengaged from the feed screw a feed screw engagable with the pushing element;

a motor to drive the feed screw and thereby advance the pushing element along the guide shaft toward the second end and advance the plurality of articles toward said second end; and a sensor system positioned to sense an article dispensed from the second end of the guide shaft, said sensor system deactivating said motor upon sensing the dispensing of an article.

12. The article dispensing apparatus of claim 11, further comprising a means for biasing the release lever in the first position.

13. The article dispensing apparatus of claim 11, wherein the release lever is pivotably mounted and a spring is positioned to urge the release lever in the first position, the spring being yieldable upon application of a desired force to allow the release lever to be pivoted to the second position.

14. An article dispensing apparatus, comprising:

a guide shaft for supporting a plurality of articles, the guide shaft having first and second ends;

a pushing element movable along the guide shaft;

a feed screw engagable with the pushing element;

a motor to drive the feed screw and thereby advance the pushing element along the guide shaft toward the second end and advance the plurality of articles toward said second end;

an iris positioned on or adjacent the second end of the guide shaft, said iris defining a yieldable opening; and a sensor system positioned to sense an article dispensed from the second end of the guide shaft, said sensor system deactivating said motor upon sensing the dispensing of an article.

15. The article dispensing apparatus of claim 14, wherein the iris includes an opening through which the articles pass, said opening being surrounded by a plurality of yieldable fingers that act to stagger the movement of articles as the articles pass through said opening.

16. An article dispensing apparatus, comprising:

a guide member for supporting a plurality of articles to be dispensed;

means for moving the articles to be dispensed along the guide member;

means for incrementally advancing the moving means to thereby incrementally advance the plurality of articles along the guide member; and means for sensing an article as the article is dispensed from the guide member and for deactivating the incremental advancing means upon sensing the dispensing of an article.

17. The article dispensing apparatus of claim 16, further comprising a means for staggering the movement of the plurality of articles along the guide member to facilitate the dispensing of individual articles.

18. The article dispensing apparatus of claim 16, wherein the incremental advancing means includes a feed screw and a motor to drive the feed screw.

19. The article dispensing apparatus of claim 18, wherein the moving means includes a pushing element movable along the guide shaft, said pushing element being selectably engagable with the feed screw.

20. An article dispensing apparatus, comprising:

a guide shaft for supporting a plurality of articles, the guide shaft having first and second ends;

a pushing element movable along the guide shaft;

means for incrementally moving the pushing element along the guide shaft to advance the plurality of articles toward the second end thereof; and an iris aligned with the second end of the guide shaft, said iris staggering the movement of the articles passing therethrough to facilitate the controlled dispensing of one article at a time.

21. The article dispensing apparatus of claim 20, wherein the iris comprises an opening surrounded by a plurality of fingers that are yieldable as an article passes through said opening.

22. The article dispensing apparatus of claim 20, further comprising a sensor system position to sense an article subsequent to the article passing through the iris, said sensor system deactivating the incremental moving means upon sensing an article.

23. A method of dispensing articles from an apparatus having at least one guide member for holding the articles, the method comprising:

moving a pushing element along the guide member to thereby advance the articles toward a dispensing end of the guide member;

sensing an article as the article is dispensed from the guide member; and stopping movement of the pushing element upon the sensing of a dispensed article.

24. A method of dispensing articles from an apparatus having at least one guide member for holding the articles, the method comprising:

moving a pushing element along the guide member to thereby advance the articles toward a dispensing end of the guide member;

advancing the articles through a yieldable opening to stagger the dispensing of the articles from the guide member;

sensing the dispensing of an article from the guide member; and stopping movement of the pushing element upon the sensing of a dispensed article.

* * * * *

UNITED STATES PATENT AND TRADEMARK OFFICE

CERTIFICATE OF CORRECTION

PATENT NO. : 6,082,580
DATED : July 4, 2000
INVENTOR(S) : Mueller et al.

It is certified that error appears in the above-identified patent and that said Letters Patent is hereby corrected as shown below:

Claim 11, column 9,
After line 3 insert new paragraph --a feed screw;--;
Line 10, after "feed screw", insert --;--.
Delete line 11, in its entirety.

Signed and Sealed this

Seventeeth Day of July, 2001

Nicholas P. Godici

*Attest:*

*Attesting Officer*

NICHOLAS P. GODICI
*Acting Director of the United States Patent and Trademark Office*